United States Patent [19]

Kumazawa

[11] 4,084,934

[45] Apr. 18, 1978

[54] COMBUSTION APPARATUS

[75] Inventor: Toshiharu Kumazawa, Fujisawa, Japan

[73] Assignee: Mitsubishi Precision Co., Ltd., Japan

[21] Appl. No.: 582,174

[22] Filed: May 30, 1975

[30] Foreign Application Priority Data

Jun. 4, 1974 Japan ..... 49-62516
Feb. 5, 1972 Japan ..... 47-14376

[51] Int. Cl.[2] ..... F23D 7/00; F23D 11/38

[52] U.S. Cl. ..... 431/189; 239/411; 239/419.3; 239/420; 239/427.5; 239/432; 60/39.74 R; 60/39.55

[58] Field of Search ..... 60/39.74 R, 39.72 R, 60/39.55, 39.53; 239/102, 432, 410–413, 419.3–427, 427.5; 431/353, 189; 261/18 A, 78 R, DIG. 48, DIG. 78

[56] References Cited

U.S. PATENT DOCUMENTS

| | | | |
|---|---|---|---|
| 2,771,744 | 11/1956 | Johnson et al. | 60/39.74 R |
| 2,920,449 | 1/1960 | Johnson et al. | 60/39.74 R |
| 3,013,383 | 12/1961 | Malick | 60/39.53 |
| 3,064,619 | 11/1962 | Fortman | 239/102 |
| 3,088,280 | 5/1963 | Lefebvre et al. | 60/39.55 |
| 3,169,508 | 2/1965 | Rich | 239/102 |
| 3,320,744 | 5/1967 | Blakly et al. | 60/39.74 R |
| 3,371,869 | 3/1968 | Hughes | 239/102 |
| 3,693,886 | 4/1972 | Conrad | 239/432 |
| 3,724,207 | 4/1973 | Johnson | 60/39.74 R |
| 3,756,575 | 9/1973 | Cottell | 239/102 |
| 3,774,846 | 11/1973 | Schurig et al. | 239/102 |
| 3,906,718 | 9/1975 | Wood | 60/39.74 R |

FOREIGN PATENT DOCUMENTS

| | | | |
|---|---|---|---|
| 1,100,535 | 1/1968 | United Kingdom | 239/102 |

*Primary Examiner*—Robert E. Garrett
*Attorney, Agent, or Firm*—Robert E. Burns; Emmanuel J. Lobato; Bruce L. Adams

[57] ABSTRACT

A nozzle for mixing a high pressure gas, a liquid fuel and water and finely dividing the latter two is connected in fluid communication with another nozzle facing an impact disperser. The mixture spouted through the latter nozzle collides with the impact disperser to be dispersed into a combustion chamber. A stream adjustment disposed around the second nozzle encircles the disperser to determine an angle at which the finely divided fuel and liquid particles are dispersed in the combustion chamber. Also an apertured paraboloidal surface encircling a nozzle can oppose to a cavity resonator to generate an impulsive wave with a high pressure gas spouted through the nozzle to finely divide liquid particles from that nozzle in the form of an emulsion.

5 Claims, 7 Drawing Figures

18
α
A3
A2
A4
A1
34
34'
P
40
40'
32
38
36
G2
62
60
AIR REGULATOR
66
20
26
30
50
52
28
24
24'
16
22
G1
R4
AIR CONTROL
R2
FLOW CONTROL
46
R3
FLOW CONTROL
48
MONITOR
64
PRESSURE CONTROL
R1
14
12
10

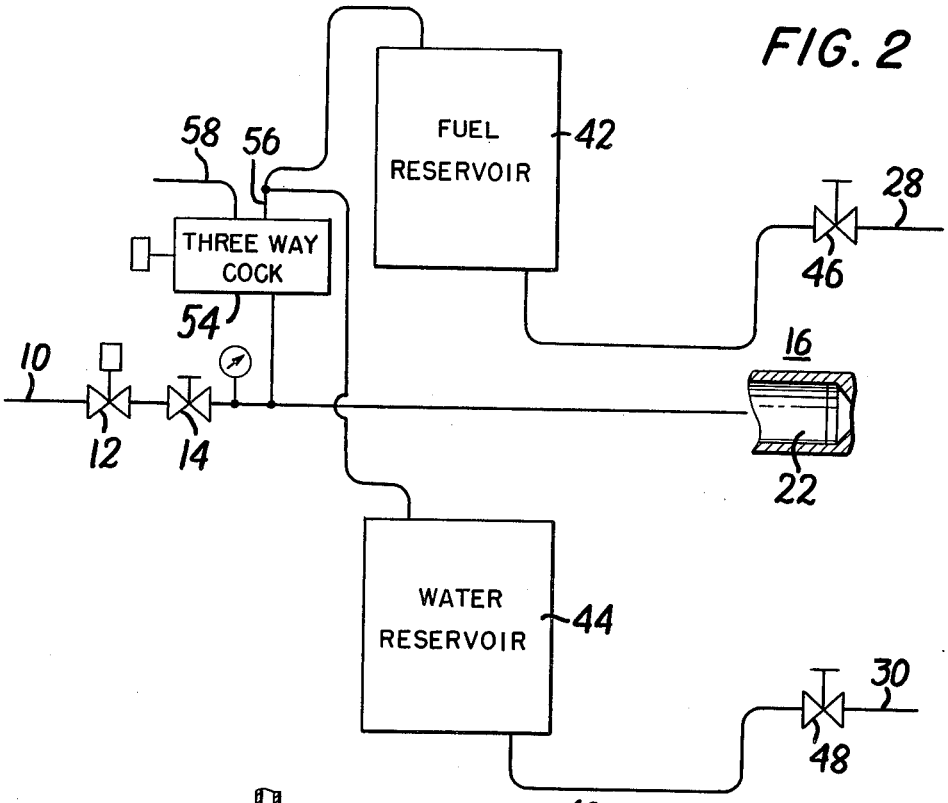
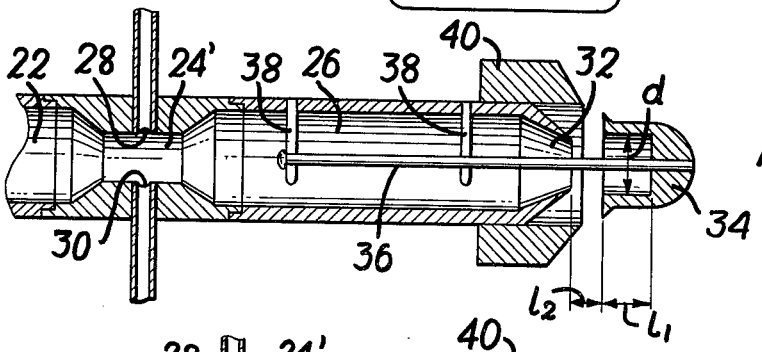
FIG. 3
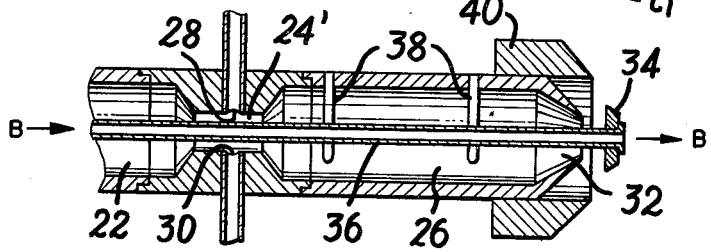
FIG. 4
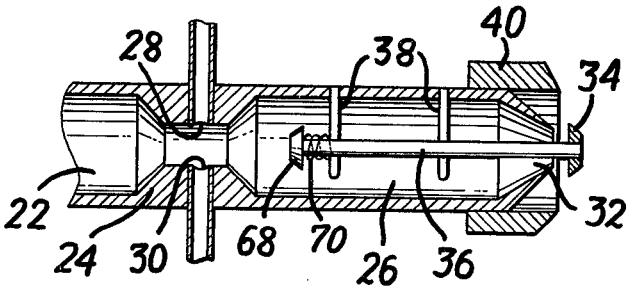
FIG. 5

COMBUSTION APPARATUS

BACKGROUND OF THE INVENTION

This invention relates to a combustion apparatus in which a finely divided liquid fuel is burnt, and more particularly to the mixture of a liquid fuel and another liquid such as water and the atomization thereof.

In order to improve the combustion characteristics of combustion apparatus to decrease the environmental pollution level of gases exhausted from the apparatus, various measures have been previously proposed and are presently being used such as the facilitation of the mixture of the liquid fuel with air, the two-stage combustion, the recirculation of gases, the mixture of the liquid fuel and water, with or without another liquid other than water simultaneously with the atomization or fine division of the mixture, etc. It is an accepted opinion that it has been generally difficult to provide effective combustion apparatus by collectively utilizing the characteristic features of those measures in the same apparatus because the resulting apparatus have encountered various problems in construction, cost etc.

The atomization or fine division of liquids such as liquid fuels has been previously accomplished by using centrifugal injection valves, impact injection valves, air injection valve, rotary discs, electro-mechanical supersonic generators etc. The use of any of such devices has generally made it difficult to produce uniform, finely divided particles and to yield a large amount of a mixture of at least two types of liquid in the form of an emulsion within a short time interval.

It is an object of the present invention to provide a new and improved combustion apparatus effectively improved in combustion characteristics, having decreased amounts of harmful ingredients included in an exhaust gas therefrom, and which consumes less fuel fuel by improving the mixing of a fuel with the air, shorting and thinning the resulting flame, increasing a quantity of heat radiated from the flame and decreasing a time interval required for the fuel-air mixture to be completely burnt.

It is another object of the present invention to provide a new and improved device, for finely dividing a liquid into uniform, finely divided particles as well as changing at least two types of liquid to a mixture of finely divided particles in the form of an emulsion, with a simple construction.

SUMMARY OF THE INVENTION

According to one aspect of the present invention, there is provided a combustion apparatus comprising, in combination, means for spouting a liquid fuel and liquids into a stream of high pressure gaseous fluid to form a mixed, finely divided fluid including the high pressure gaseous fluid and finely divided particles of the liquid fuel, nozzle means for spouting the mixed finely divided fluid at a high speed into a combustion chamber, and an impact disperser member disposed downstream of the nozzle means to collide with the finely divided fluid spouted through the nozzle means thereby to disperse the spouted fluid into the combustion chamber as more finely divided particles.

Dispersion adjustment means may be preferably disposed around the nozzle means to determine an angle through which the impact disperser member spouts the more finely divided fluid into the combustion chamber.

In order to automatically control the angle of dispersion through which the impact disperser member spouts the more finely divided fluid into the combustion chamber, supporting means may be advantageously disposed upstream of the nozzle means to support the impact disperser member for movement in a direction of flow of the finely divided fluid on the upstream side of the nozzle means.

According to the other aspect of the present invention, there is provided a device for finely dividing a liquid, comprising in combination, nozzle means for passing a high pressure gaseous fluid therethrough, impulsive wave generator means including a cavity resonator member to generate an impulsive wave through the use of the high pressure gaseous fluid emerging from the nozzle means, and conduit and port means for introducing into the nozzle means a liquid to be finely divided.

In the preferred embodiment of the present invention, the impulsive wave generator means may be in the form of a hollow cylinder having an annular concave end surface on the downstream side facing the cavity resonator member to impart a directivity to a stream of finely divided particles of the liquid spouted through the nozzle means while another nozzle means id disposed upstream of and in fluid communication with the firstmentioned nozzle means and has the conduit and port means opening therein.

BRIEF DESCRIPTION OF THE DRAWINGS

The present invention will become more readily apparent from the following detailed description taken in conjunction with the accompanying drawings in which:

FIG. 2 is a block diagram useful in explaining the supply of a liquid fuel and a liquid to be mixed therewith to the mixing tube shown in FIG. 1;

FIGS. 3, 4 and 5 are longitudinal sectional views of different modifications of the mixing tube and impact disperser shown in FIG. 1;

DESCRIPTION OF THE PREFERRED EMBODIMENTS

Figure 1:
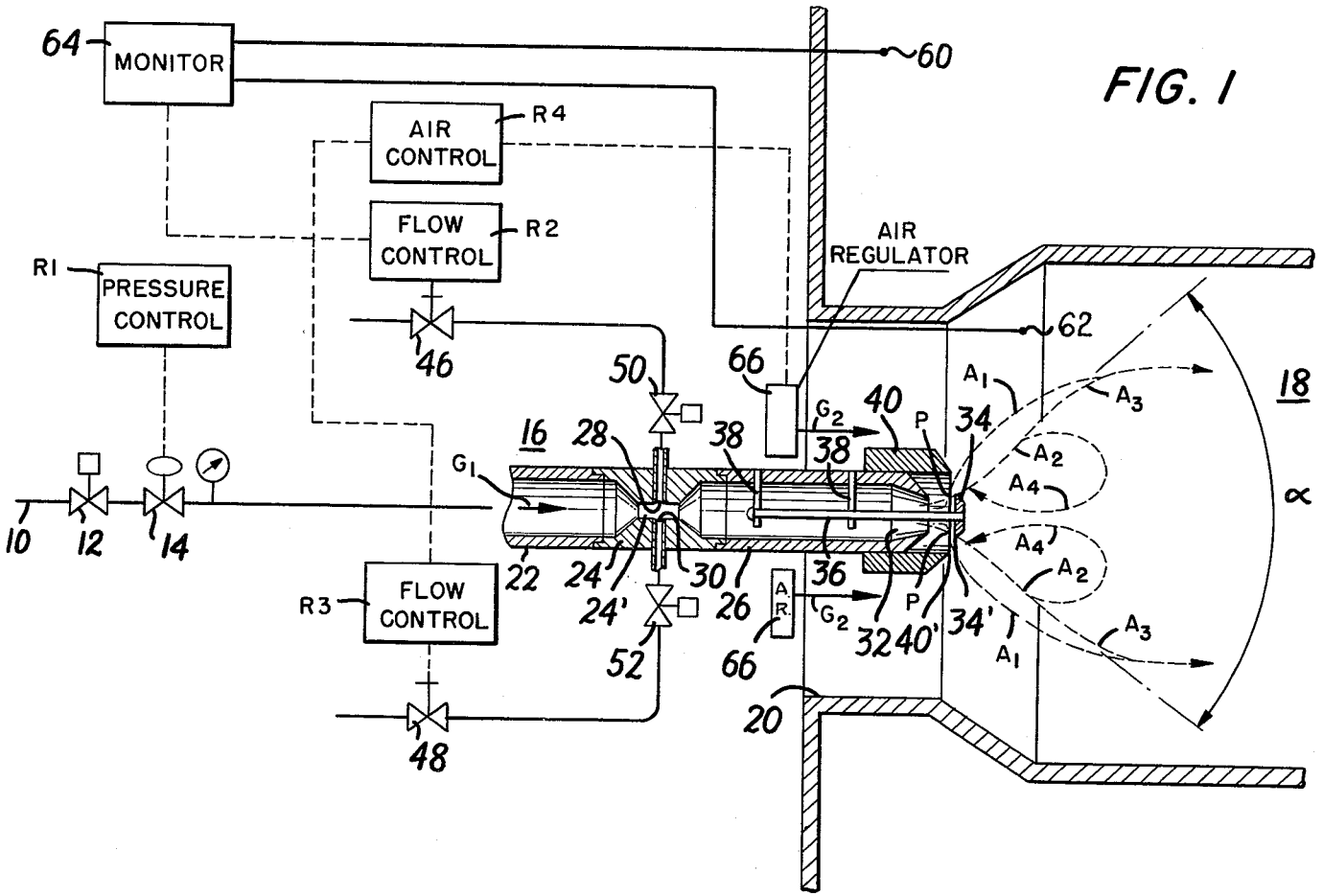
FIG. 1 is a fragmental longitudinal sectional view of a combustion apparatus embodying one aspect of the present invention will associated fluid feed systems schematically illustrated in block diagram.

Referring now to FIG. 1 of the drawings, there is illustrated one portion of a combustion apparatus embodying one aspect of the present invention. The arrangement illustrated comprises a fluid line 10 from a source of high pressure gaseous fluid (not shown) including a stop valve 12 and a pressure control valve 14, a circular tube generally designated by the reference numeral 16 and connected at one end to the fluid line 10, and a combustion chamber (only one portion of which is illustrated) generally designated by the reference numeral 18 and including an inlet port 20. The circular tube 16 has the other end portion extending through the inlet port 20 into the combustion chamber 18 so that the longitudinal axis of the circular tube 16 is substantially aligned with that of the combustion chamber 18.

The circular tube 16 is formed of a high pressure fluid tube section 22, a nozzle member 24 including a nozzle 24' and a mixing tube section 26. The high pressure tube section 22 is connected directly to the fluid line 10 and a plurality in this case, two of fluid feed conduits 28 and 30 open in the nozzle 24' in the nozzle member 24. In the example illustrated, the fluid feed conduit 28 serves to deliver a liquid fuel to the nozzle 24' in the nozzle member 24 while the fluid feed conduit 30 serves to deliver a liquid into the nozzle 24' the liquid being mixed with the fuel.

The mixing tube section 26 terminates at an atomizing nozzle 32, and an impact disperser 34 in the form of a truncated cone is located in front of the nozzle 32 or downstream thereof by having the larger diameter face thereof opposite and substantially normal to the longitudinal axis of the circular tube 16. To this end, a supporting rod 36 is hung on a pair of spaced studs 38 radially inwardly extending from the peripheral wall of the mixing tube section 26 so as to lie on the longitudinal axis of the mixing tube section 26 until one extremity thereof protrudes beyond the nozzle 32 and has the impact disperser 34 rigidly secured thereat to be normal to the axis of the rod 36. Then a stream adjustment 40 in the form of a hollow cylinder is fitted onto that end portion of the mixing tube section 26 including the nozzle 32 and projects beyond the end face of the mixing tube section 26 until a tapered peripheral edge 40' thereof is at a position just short of the larger diameter face of the impact disperser 34. The acute edge 40' is radially outwardly spaced from the acute peripheral edge 34' of the larger diameter face of the disperser 34 to form an annular gap therebetween. The stream adjustment 40 is preferably controllable in its axial position relative to the mixing tube section 26. The adjustment 40 and the impact disperser 34 are positioned within the inlet of the combustion chamber 18.

The operation of the arrangement as shown in FIG. 1 will now be described in conjunction with a mixture of a liquid fuel and water. It is to be understood that a liquid fuel alone, a mixture of a liquid fuel and a liquid other than water or a mixture of a liquid fuel, water and a liquid other than water can be effectively and efficiently burnt in the combustion chamber 18. With the stop valve 12 put in its open position, a high pressure gaseous fluid from the fluid feed line 10 passes through the valve 12 and valve 14 where it is suitably controlled in pressure. Then the gaseous fluid flows into the high pressure tube section 22. The high pressure gas labelled G1 within the high pressure tube section 22 is spouted at a high speed into the mixing tube section 26 through the nozzle 24' in the nozzle member 24. At that time a liquid fuel and water are spouted into the nozzle 24' through the respective feed conduits 28 and 30 to be finely divided and mixed with each other and with the high pressure gaseous fluid. The resulting gaseous mixture including finely divided particles of the fuel and water is passed from the nozzle member 24 through the mixing tube section 26 while the fuel, water and gaseous fluid are being more thoroughly mixed with one another. Eventually the mixture is spouted into the combustion chamber 18 through the nozzle 32.

The mixture of the fuel and water in the form of finely divided particles and the high pressure gaseous fluid spouted into the combustion chamber 18 collides with the impact disperser 34 to be dispersed. Under these circumstances, a phenomenon continuously occurs in which the dispersed mixture again collides with the succeeding similar mixture resulting in its being dispersed into a shape approximating a cone having an angle of dispersion $\alpha$. More specifically, the mixture collides with the larger diameter face of the impact disperser 34 to form a stream as shown at dotted line $A_1$ in FIG. 1. While that stream $A_1$ of the mixture is further moving into the combustion chamber 18 it again collides with the similar follow stream and some of the stream $A_1$ strikes against the tapered or beveled edge 34' of the impact disperser 34 to form a second stream as shown at dotted line $A_2$ in FIG. 1. The stream $A_2$ of the mixture includes more finely divided particles of the fuel and water. The stream $A_2$ is followed by a third stream $A_3$. As a result, the mixture of the gaseous fluid and the finely divided particles of the fuel and water as a whole is dispersed into a shape approximating a cone having an angle of dispersion $\alpha$ until it is effectively burnt within the combustion chamber 18.

It has been found that the collision of one with the other of the liquid fuel and water is noticeably caused particularly at the intersection of the streams $A_1$ and $A_2$ (which is in a circle including a point P, see FIG. 1, and lying in a plane normal to the longitudinal axis of the mixing tube section 26 and therefore of the impact disperser 34.) This collision increases the effect of fine division and mixture.

Also the collision of the mixture with the upstream face of the impact disperser 34 causes a decrease in pressure on the rear or downstream face thereof resulting in one portion of the stream $A_2$ dragging radially inwardly of the longitudinal axis of the combustion chamber 18 and then toward the rear face of the disperser 34 to form a fourth stream as shown at dotted line $A_4$ in FIG. 1. The stream $A_4$ of the mixture thus formed is effective for heating, and vaporizing or gasifying the finely divided fuel and water particles included in the succeeding mixture caused from the recirculation of the gaseous combustion product. Thus the combustion can be stably accomplished, starting with the rear or downstream face of the impact disperser 34.

In addition, the pair of studs 38 serve to cause a tubulent flow in the stream of the mixture of the gaseous fluid and finely divided particles of the fuel and water flowing through the mixing tube section 26 resulting in more effective mixture and fine division.

The angle of dispersion $\alpha$ depends upon a speed at which the mixture of high pressure gas fuel and water is spouted through the nozzle 32, a distance between the extremity of the nozzle 32 and the collision face of the impact disperser 34, and the area of that collision face. Further the acute edge 40' of the stream adjustment 40 can be positioned along the longitudinal axis of the mixing tube section 26 to adjust both the angle of dispersion $\alpha$ and an extent to which the cone-shaped dispersed stream is made thin. For example, if the stream adjustment 40 more closely approaches the impact disperser 34, the angle of dispersion $\alpha$ will become smaller with the result that, by colliding the first stream $A_1$ with the acute edge 40' of the adjustment 40 the particles included in the stream $A_1$ of the mixture are more finely divided while at the same time, the stream as a whole is rendered thinner. For this reason, the stream adjustment 34 is preferably adjustable in its position along the longitudinal axis of the mixing tube section 26.

Also the dispersion shape depends upon the shape of the impact disperser 34 and an angle of the latter relative to the longitudinal axis of the mixing tube section 26 and therefore of the supporting rod 36. In FIG. 1 the impact disperser 34 is shown as having the collision face substantially normal to the supporting rod 36 in order to provide a dispersion pattern approximating a cone and symmetrical with respect to the longitudinal axis of the mixing tube section 26. If desired, the impact disperser 34 may be tilted to the longitudinal axis of the mixing tube section 26.

While the liquid fuel and water may be supplied to the feed conduits 28 and 30 by using respective individual feed pumps (not shown) their supply to the feed conduits 28 and 30 is effectively accomplished by utilizing a difference between a fluid pressure in the high pressure fluid line 10 and a reduced pressure developed on the nozzle 24' in the nozzle member 24.

In the latter event, a fuel reservoir 42 (see FIG. 2) is connected to the fuel feed conduit 28 through a flow-rate control valve 46 and a stop valve 50 as shown in FIGS. 1 and 2. Similarly a water reservoir 44 (see FIG. 2) is connected to the water feed conduit 30 through a flow-rate control valve 48 and a stop valve 52. As shown in FIG. 2, a fluid pressure within the feed line 10 controlled by the pressure control valve 14 is applied to both the fuel and water reservoirs 42 and 44 respectively through a three-way cock 54 and a pressurizing fluid conduit 56. Thus each of the fuel and water from its own reservoir 42 or 44 is supplied to the nozzle member 26 through the valves 46 and 50 or 48 and 52 and the feed conduit 28 or 30 in response to a difference between the fluid pressure applied to its own reservoir 42 and 44 and a reduced pressure appearing at the nozzle 24' in the nozzle member 24 while each of the fuel and liquid is controlled in flow rate by the individual control valve 46 or 48.

The three-way cock 54 is also connected to a vent pipe 58. When the particular combustion has been completed or when it is required to be suspended, the stop valve 12 is brought into its closed position while the three-way cock 54 is turned to connect the pressurizing conduit 56 to the vent pipe 58. This causes the high pressure gaseous fluid to sto being supplied to the nozzle member 26 and permits the fluid pressure within each reservoir 42 or 44 to escape through the conduit 56, the valve 54 and the vent pipe 58 to the atmosphere thereby to interrupt the supply of the fuel and water to the nozzle member 26. Therefore no mixture of the high pressure gaseous fluid and finely divided fuel and water particles is supplied to the combustion chamber 18.

in order to control the fuel and water flow through the individual feed conduits 28 or 30, a control system comprises a temperature sensor 60 suitably disposed around the combustion chamber 18 for sensing a temperature of an object to be heated by the combustion chamber 18, for example an amount of water and a status sensor 62 suitably disposed within the combustion chamber 18 for sensing the status of combustion within the chamber 18. Both sensors 60 and 62 schematically shown as a dot are connected to a monitor 64. The monitor 64 is responsive to either or both of the sensed signals provided by the sensors 60 and 62 to produce a control signal. In response to the control signal from the monitor 64, a pressure control R1 controls the opening position of the pressure control valve 14, and flow controls R2 and R3 control the flow-rate control valves 46 and 48 respectively. Further the monitor 64 actuates an air control R4 to control an inflow regulator 66 disposed in close proximity of the inlet port 20 of the combination chamber 18 to encircle the mixing tube section 26 to regulate an amount of air G2 directly flowing into the combustion chamber 18. If desired, the various control valves and the inflow regulator may be manually operated in accordance with the control signal from the monitor 64. In this way the fuel, water and air supplied to the combustion chamber 18 are maintained in their optimum flow rates.

A change in liquid level within each reservoir 42 or 44 may cause a variation in pressure under which the liquid is delivered to the associated feed conduit 28 or 30 resulting in a change in flow rate within that conduit. If it is required to compensate for this change in flow rate then each reservoir may be provided with a pressure sensor for sensing a pressure at the bottom thereof and a signal sensed by the sensor is applied to each of the flow controls R2 and R3 for control purposes although such sensors and their connection to the control R2 and R3 are not illustrated in FIG. 1.

While the impact disperser 34 has been described as having a circular cross section it is to be understood that the impact disperser 34 is not restricted thereby or thereto and that it may be of any desired cross section such as a polygonal or an unsymmetrical cross section. Also instead of the flat face, the collision face of the impact disperser 34 may be convex, concave or conical for the particular application.

FIGS. 3, 4 and 5 wherein like reference numerals designate the components identical or similar to those shown in FIG. 1 illustrate different modifications of the impact disperser 34. In FIG. 3 the impact disperser 34 is in the form of a hollow cylinder open at one end and closed at the other end with a hemisphere. In other respects, the arrangement is identical to that shown in FIG. 1. The arrangement can be operated as a cavity resonance sound-energy generator by properly selecting both the inside diameter $d$ of the hollow cylinder, the length $l_1$ of the hollow cylinder and a distance $l_2$ between the extremity of the nozzle 32 and the open end of the hollow cylinder dependent upon a speed of spouted mixture from the nozzle 32. In the latter event, high intensity sound energy is generated at a resonance frequency determined by the cavity of the impact disperser 34 and can be used to more finely divide the mixture of high pressure gas, fuel and water and more completely mix them with one another while at the same time a combustion speed increases due to a turbulence produced in the resulting flame.

An arrangement as shown in FIG. 4 is different from that illustrated in FIG. 1 only in that the supporting rod 38 is replaced by a small tube 36' extending through the entire tube 16 and connected at one end to a source of high pressure fluid through a flow control valve although the source and control valve are not illustrated. The small tube 36' has the other end opening on the downstream face of the impact disperser 34. In other respects the arrangement is identical to that shown in FIG. 1. The arrangement of FIG. 4 is advantageously used to directly deliver air or any other suitable fluid B to a desirable position within the combustion chamber to be mixed with a flame established therein.

If desired, the impact disperser may be movable with respect to the nozzle 32 and axially of the mixing tube section 26 as shown in FIG. 4. As shown in FIG. 5, the supporting rod somewhat extends toward the nozzle member 24 and is provided on the extended end with a disc 68 for bearing a pressure provided by the mixture of high pressure gas, fuel and water spouted through the nozzle member 24. Then a compression spring 70 is disposed between the pressure bearing disc 68 and that stud 38 nearer to the nozzle member 24 and around the extension of the supporting rod 36. In the arrangement of FIG. 5 the supporting rod 36 and therefore the impact disperser 34 is movable along the longitudinal axis of the mixing tube section 26 in response of the pressure of the high pressure gaseous fluid and under control of the compression spring 70 thereby to automatically change the distance between the extremity of the nozzle 32 and the impact disperser 34. This permits the automatic control of the angle of dispersion. Namely the pressure bearing disc 68 forms an automatic angle-of-dispersion control with the spring 70. In other respects the arrangement is identical to that shown in FIG. 1.

The present invention has several advantages. For example, the present combustion apparatus can increase an angle of dispersion of a flame and make the flame thin. Particularly, finely divided particles of water expand and explosively scatter in the region of combustion to promote more finely dividing of the finely divided fuel particles. This results in a rapid increase in flame temperature, a decrease in a time interval required for the completion of combustion, improvements in the composition of the exhaust gas and saving of the fuel. In addition, by forming a transition portion between the inlet and the main body of the combustion chamber 18 into a truncated cone having an angle at the vertex equal to the optimum angle of dispersion selected to improve the combustion efficiency, the composition of the exhaust gas etc. as shown in FIG. 1, a thermal energy generated from such a combustion chamber can be effectively used.

While the present invention has been described in conjunction with a mixture of a high pressure gas, a liquid fuel and water it is to be understood that a burning gas, a liquid fuel and more than one type of liquid can be effectively mixed with one another and finely divided for combustion. In the latter event the required number of feed conduits such as conduits 28 and 30 can may be opened in the nozzle 26' in the nozzle member 26 and preferably at equal angular intervals. Furthermore a plurality of sets of the mixing tube sections 26 and the associated components may be operatively coupled in parallel relationship to a single combustion chamber to increase the ability of combustion.

Figure 6:
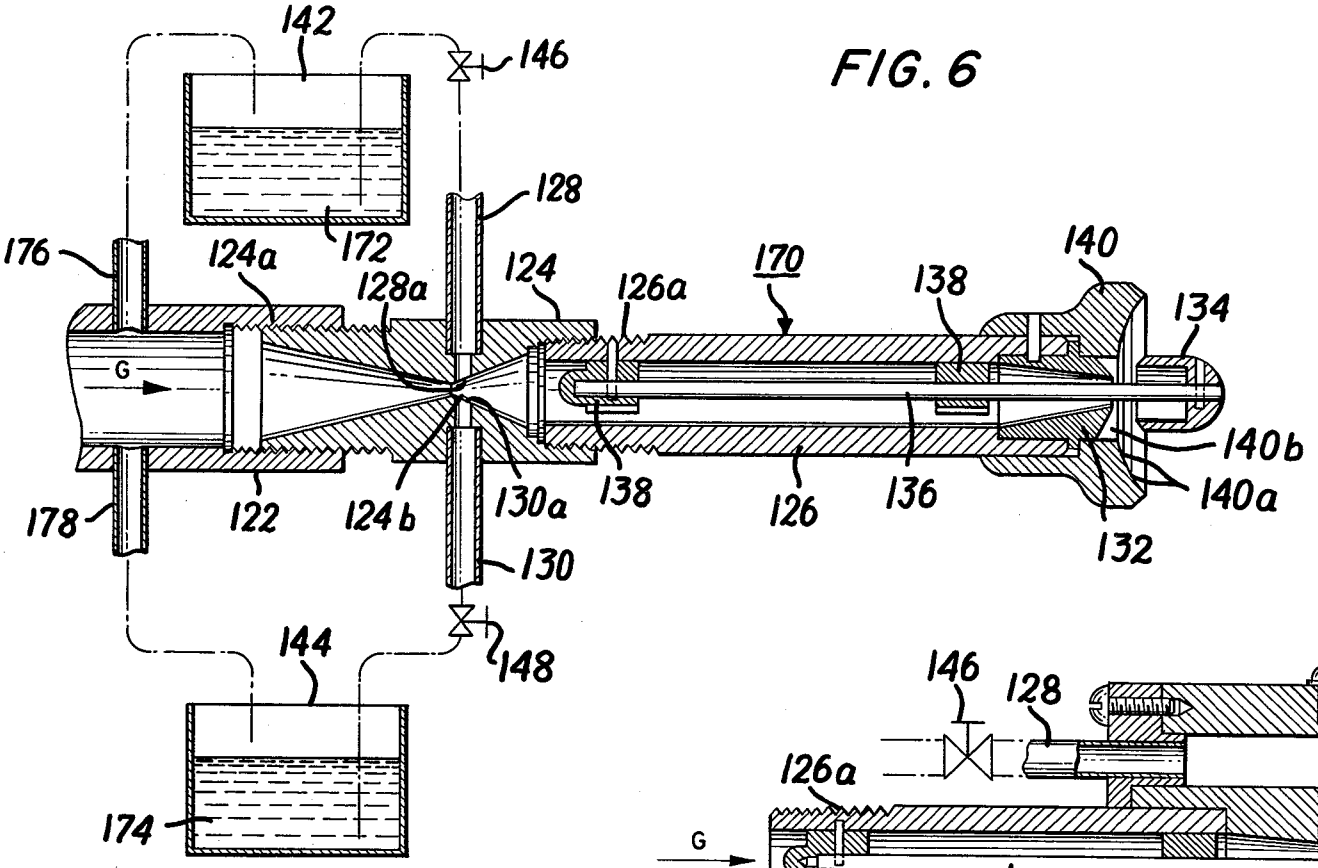
FIG. 6 is a longitudinal sectional view of a device for atomizing a liquid into finely divided particles constructed in accordance with the other aspect of the present invention.

Referring now to FIG. 6, there is illustrated a device for finely dividing liquids in accordance with the other aspect of the present invention. The arrangement illustrated comprises a high pressure gaseous fluid tube 122 having a high pressure gaseous fluid G externally applied to one end thereof, a nozzle member 124 including one end portion **124*a* screw threaded into the other end portion of the tube 122 and a nozzle 124*b* disposed therein, and a combined impact and resonance type sonic generator generally designated by the reference numeral 170 and operatively connected to the nozzle member 124. A liquid feed conduit 128 is connected to a liquid reservoir 142 through a flow-rate control valve 146 and has an outlet port 128*a* opening in the nozzle 124*b*. Similarly another liquid feed conduit 130 is connected to a separate liquid reservoir 144 through a flow-rate control valve 148 and has an outlet port 130*a* opening in the nozzle 124*b* to be diametrically opposite to the outlet port 128*a***.

The liquid reservoir 142 includes an amount of one type of liquid 172 therein and the liquid reservoir 142 similarly includes an amount of the other type of liquid 174 therein. Both types of liquid 172 and 174 are adapted to be mixed with each other and finely divided as will be described thereinafter. The liquid reservoirs 142 and 144 are connected to the high pressure fluid tube 122 through respective pressure transfer tubes 176 and 178 so that a fluid pressure within the tube 122 is applied to both types of liquid 172 and 174 disposed in the reservoirs 142 and 144 for the purposes as will be apparent later.

The combined impact and resonance type sound generator 170 includes a hollow cylinder 126, having one end portion screw threaded into the other end portion of the nozzle member 124 and a nozzle member 132 rigidly fitted into the other end portion of the hollow cylinder 126 and fixed thereto as by a pin. A supporting rod 136 is supported to a pair of spaced studs 138 fixed to the inner peripheral wall of the hollow cylinder 126 so as to run within the hollow cylinder 126 and the nozzle member 132 on the longitudinal axis thereof. Then the supporting rod 136 protrudes beyond the nozzle member 132 and includes a primary cavity resonator 134 rigidly secured to the exposed end thereof as by a pin. The primary cavity resonator 134 is in the form of a hollow cylinder open at on end or that end adjacent to the nozzle member 132 and closed at the other and with a hemisphere. The open end of the resonator 134 is defined by an acute edge.

The sonic generator 170 further includes an impulse-wave generator 140 of annular shape and fixed thereto by a pin. That surface **140*a* of the generator 140 adjacent to the primary resonator 134 or the downstream surface thereof is concave toward the nozzle member 132 and having a central opening within which the tapered end portion of the nozzle member 132** is located to form a secondary cavity resonator 140*b* with the inner wall surface of that central opening. The concave surface **140*a* has a curvature suitable for generating an impulsive wave. The primary resonator 134 is partly disposed in a spaced defined by the concave surface 140*a* of the generator 140**.

In operation, the high pressure gaseous fluid G externally supplied to the high pressure tube 122 flows through the nozzle member 124 and the hollow cylinder 126 until it is spouted through the nozzle member 132. That spouted gas from the nozzle member 132 vibrates the primary cavity resonator 134 at its resonance frequency to generate an impulsive wave from the impulsive wave generator 140. The concave surface **140*a* of the wave is formed to impart a predetermined directivity to the impulsive wave thus formed. For example, the surface 140*a* can be in the form of a paraboloid having a focus on the extension of the longitudinal axis thereof with the cavity resonator 134 disposed at the focus. In that event there is generated a field of sound wave having a high energy and a directivity on he longitudinal axis of the wave generator 140**.

On the other hand, due to a pressure differential between the high fluid pressure within the tube 122 applied to each liquid reservoir 142 or 144 and a reduced pressure developed in the nozzle **124*b*, the liquid from each reservoir 142 or 144 is sucked and introduced into the nozzle 124*b* through the respective conduit, control valve and outlet port. Within the nozzle 124*b* both types of liquid 172 and 174 are finely divided and mixed with each other and with the high pressure gaseous fluid G passed through the nozzle 124*b*. The resulting mixture flows through the hollow cylinder 126 while the mixing is more completely effected until it is spouted into the field of sound wave through the nozzle member 132. Within the field of sound wave, the spouted mixture is more finely divided into an emulsion with the sound energy at a high level present therein. Under these circumstances either or both of the flow-rate control valves 146 and 148** may be operated to adjust a mixing ratio of one to the other of the types of finely divided liquid whenever it is desired to do so.

Figure 7:
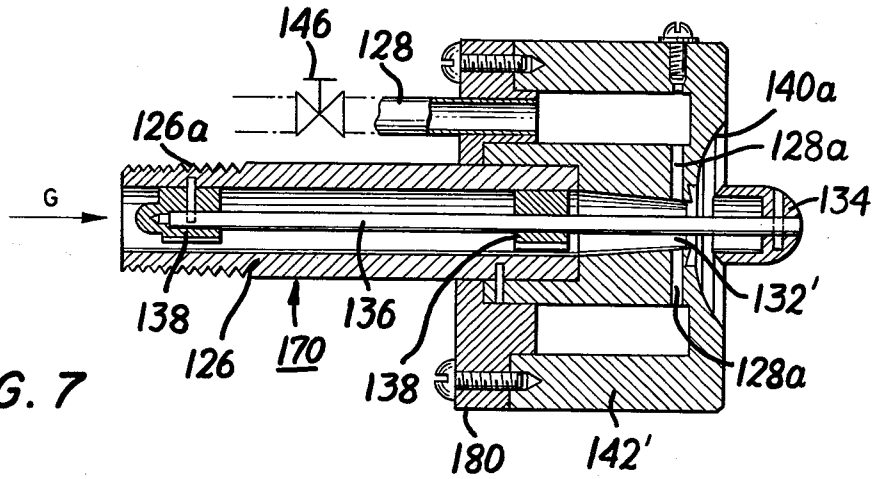
FIG. 7 is a view similar to FIG. 6 but illustrating a modification of the arrangement shown in FIG. 6.

FIG. 7 wherein like reference numerals designate the components identical or corresponding to those shown in FIG. 6 illustrates a modification of the arrangement as shown in FIG. 6. In the arrangement illustrated, a high pressure gaseous fluid G1 from a source of high pressure fluid (not shown) is directly supplied to one open end of the hollow cylinder 126 with the high pressure fluid tube 122, the nozzle member 124 and the associated components omitted. An annular liquid reservoir 142' open at one end and closed at the other end is fitted onto the other open end portion of the hollow cylinder 126 and fixed thereto as by a pin. More specifically, the annular reservoir 142' has a central stepped opening including a larger diameter portion rigidly fitted onto the hollow cylinder 125 and a smaller diameter portion defining a nozzle portion 132' smoothly connected to the interior of the hollow cylinder 126. In order to communicate the interior of the liquid reservoir 142' with the nozzle portion 132' a plurality of radial passageway **128*a'* (only two of which are illustrated) extend through the internal wall of the reservoir 140' adjacent to the inner wall surface of the closed end thereof. Then the outer wall surface of the closed reservoir end is provided with an apertured concave surface 140*a* as above described in conjunction with FIG. 6**.

An annular cover plate 180 is detachably fastened to the annular open end of the annular reservoir 142' as by set screws to close that open end in fluid tight relationship. The cover plate 180 has a fluid feed conduit 128 extending therethrough and sealed and including a flow-rate control valve 146. The conduit 128 serves to supply a liquid to be finely divided to the reservoir 142'. The liquid within the reservoir is introduced into the nozzle 132' through the passageways **128'*a* due to the gaseous fluid G flowing through the nozzle 132'** at a high speed.

In other respects the arrangement is substantially identical to that shown in FIG. 6.

From the foregoing it will be appreciated that the present invention as shown in FIGS. 6 or 7 provides a device for finely dividing one or two types of liquid to form uniform, finely divided particles and has a very simple construction.

The arrangement as shown in FIGS. 6 or 7 is effectively used for purposes of increasing the combustion efficiency, humidifying, spraying, cooling, spray drying, separating a solvent from a solute as in salt-to-fresh water conversion, etc. Among them an increase in combustion efficiency is extremely advantageous in that perfect combustion is promoted, fuel is saved and the problems of environmental pollution are reduced or eliminated. This may be attributed to the fact that components of a liquid fuel, for example an oil and water, are finely divided and mixed with each other by the action of the nozzle and sound energy as above described in conjunction with FIG. 6, thereby to increase the surface area of the fuel particles due to the thermal expansion of finely divided water particles distributed among the finely divided fuel particles, to disturb the interior of the flame volume with the sound energy at a high level, to promote the chemical combustion in the presence of the finely divided water particles and so on.

The present invention has been illustrated and described in conjunction with several preferred embodiments but it is to be understood that numerous changes and modifications may be resorted to without departing from the spirit and scope of the present invention. For example, the arrangement of FIG. 6 may be substituted for the circular tube 16 and the impact disperser 34 as shown in FIG. 1. The arrangements as shown in FIGS. 1 and 6 may be modified to finely divide only one type of liquid by omitting one of the liquid feed systems or maintaining that flow-rate control valve disposed in the feed system in its closed position. On the contrary, those arrangements may be used to finely divide and mix more than two types of liquid. In the latter case the number of the feed conduits 28 and 30 (FIG. 1) and therefore the outlet ports **128*a* and 130*a* (FIG. 6) may be accordingly increased and separate liquid reservoirs such as the reservoir 142 or 144 are operatively coupled to the additional feed conduits with respective flow-rate control valves. In the arrangement of FIG. 7, the annular liquid reservoir 142' may be axially divided into the required number of compartments by axial partitions while each of the compartments is provided with an individual feed conduit such as the conduit 128' with its own flow-rate control valve 146 and a separate passageway or passageways such as shown by 132'**.

What we claim is:

1. A device for producing a dispersion stream of an emulsive mixture of a liquid fuel, water and a high pressure gas introduced into the device, comprising:

an axially extending first nozzle element having an inlet for axially introducing therein a high pressure gas, a convergent section disposed at a downstream side of the inlet for accelerating said introduced high pressure gas, a divergent section disposed downstream from said convergent section for causing an expansion of said accelerated high pressure gas, a constant diameter section conjoining said convergent and divergent portions for flowing said high pressure gas therethrough, and at least two separate ports opening into said constant diameter section for concurrently but separately introducing said liquid fuel and water, respectively, under pressure into a flow of said high pressure gas through said constant diameter section in a direction perpendicular to a central axis of said first nozzle element, wherein said flow of said high perssure gas is subjected to a hydrodynamic pressure reduction by which said introduced liquid fuel, water and high pressure gas are caused to undergo a first stage mixing and atomizing;

an axially extending tube element for causing a second stage mixing and atomizing of said liquid fuel, water and high pressure gas, said tube element having an upstream and thereof connected to a downstream end of said divergent section of said first nozzle element, a pair of internal radial studs which are axially spaced apart from one another, and an axial rod mounted centrally within said tube element on said studs and extending toward and beyond a downstream end of said tube element, said radial studs enhancing said second stage mixing and atomizing of said liquid fuel, water and said high pressure gas by inducing turbulence in the flow of fuel, water and high pressure gas through said tube element and by collison of the flow against said studs;

a second nozzle element connected to said downstream end of said tube element and having a convergent outlet for accelerating and converging the mixed and atomized stream of said liquid fuel, water and high pressure gas delivered from said tube element, prior to continuous spouting of said mixed and atomized stream from said second nozzle, and a hollow cylindrical impact disperser held at a downstream side of said convergent outlet of said second nozzle element by said axial rod extending from said tube element, said impact disperser being disposed spaced axially at a distance from said convergent end of said second nozzle element for causing said accelerated and converged stream from said second nozzle element to impinge against said impact disperser thereby causing a third stage mixing and atomizing of said stream of said liquid fuel, water and high pressure gas, said impact disperser comprising means for reflecting and for dispersing said impinging stream into an adjacent combustion space at a wide angle, said distance between said impact disperser and said convergent outlet of said second nozzle element being selected so that said stream reflected by said impact disperser is subjected to a fourth stage mixing and atomizing to form said dispersion stream of said emulsive mixture by collision thereof with a part of said stream which is continuously spouted from said second nozzle.

2. A device as claimed in claim 1, wherein a cylindrical sleeve for dispersion angle adjustment is axially and movably disposed around said second nozzle element to adjust the extent of said wide angle through which said impact disperser disperses said dispersion stream of said emulsive mixture into said adjacent combustion space.

3. A device as claimed in claim 2, wherein said cylindrical dispersion angle adjustment sleeve is formed, at its downstream end, with an acute peripheral edge to forcedly converge said mixed and atomized stream of said liquid fuel, water and high pressure gas spouted from said second nozzle element, thereby attaining said adjustment of the extent of said wide angle through which said impact disperser disperses said dispersion stream of said emulsive mixture into said adjacent combustion space.

4. A device as claimed in claim 1, wherein said pair of radial studs axially movably support said axial rod holding said impact disperser, and wherein resilient pressure responsive control means is disposed between said axial rod and said pair of radial studs for controlling axial movement of said axial rod and said impact disperser in response to the pressure of said high pressure gas introduced into said first nozzle element, thereby effectuating automatic control of said wide angle through which said dispersion stream of the emulsive mixture is dispersed by said impact disperser.

5. A device as claimed in claim 4, wherein said resilient pressure responsive control means is a compression coil spring wound on a portion of said rod adjacent to an upstream end of said rod, said upstream end of said axial rod being provided with a disc against which one end of said compression coil spring bears, and another end of said compression coil spring bearing against one of said pair of radial studs, whereby pressure applied to said disc is effective to compress said spring and move said rod axially downstream.

* * * * *